US005857447A

United States Patent [19]

Shinohara

[11] Patent Number: 5,857,447

[45] Date of Patent: Jan. 12, 1999

[54] TESTING APPARATUS FOR FUEL VAPOR TREATING DEVICE

[75] Inventor: Susumu Shinohara, Toyota, Japan

[73] Assignee: Toyota Jidosha Kabushiki Kaisha, Toyota, Japan

[21] Appl. No.: 893,270

[22] Filed: Jul. 15, 1997

[30] Foreign Application Priority Data

Jul. 16, 1996 [JP] Japan ..... 8-186099

[51] Int. Cl.[6] ..... F02M 33/04

[52] U.S. Cl. ..... 123/520

[58] Field of Search ..... 123/516, 518, 123/519, 520, 198 D

[56] References Cited

U.S. PATENT DOCUMENTS

| | | | |
|---|---|---|---|
| 5,295,472 | 3/1994 | Otsuka et al. | 123/520 |
| 5,317,909 | 6/1994 | Yamada et al. | 123/520 |
| 5,425,344 | 6/1995 | Otsuka et al. | 123/520 |
| 5,671,718 | 9/1997 | Curran et al. | 123/520 |
| 5,690,076 | 11/1997 | Hashimoto et al. | 123/520 |

OTHER PUBLICATIONS

U.S. Patent application No. 08/624,009.

*Primary Examiner*—Thomas N. Moulis
*Attorney, Agent, or Firm*—Kenyon & Kenyon

[57] ABSTRACT

An apparatus for testing seal of a fuel vapor treating device that collects fuel vapor generated in a fuel tank and treats the vapor without releasing it into the atmosphere. The treating device is provided with a canister that collects the fuel vapor through a vapor line. A vapor control valve connected to the canister adjusts the flow of fuel vapor directed toward the canister from the tank. A pressure sensor is provide to detect the pressure in the tank. An electronic control unit (ECU) controls the purge control valve and the three-way valve. The ECU counts the number of deviations of the detected pressure when the detected pressure is within a predetermined range. The ECU determines whether the seal is normal or malfunctioning based on the detected pressure when the counted value is smaller than a predetermined value.

18 Claims, 13 Drawing Sheets

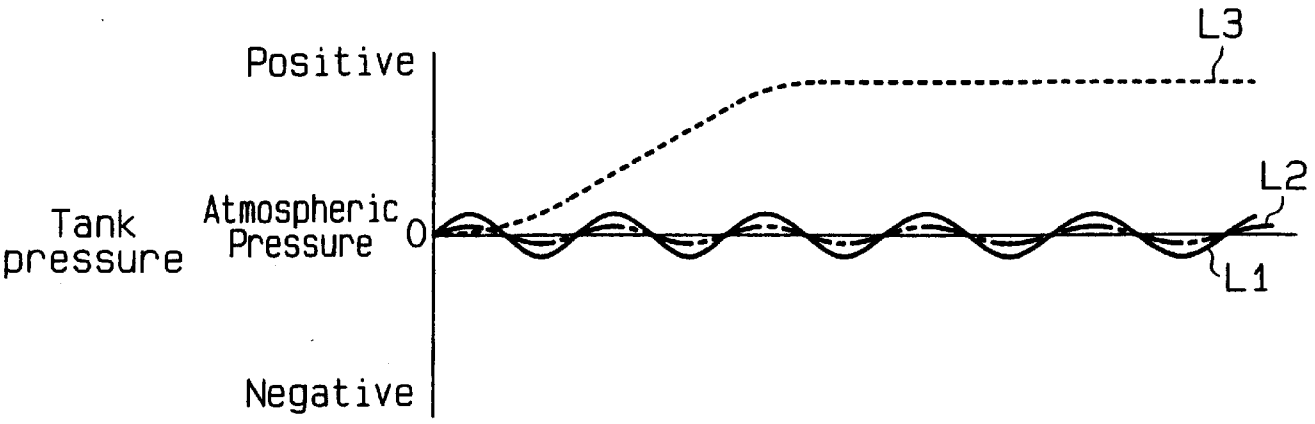
Fig.16 (a) (PRIOR ART)
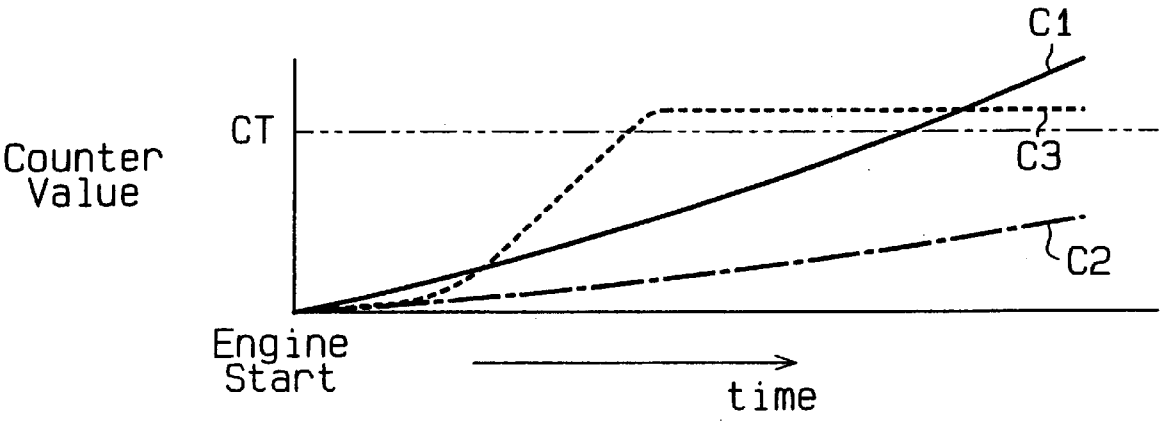
Fig.16 (b) (PRIOR ART)

TESTING APPARATUS FOR FUEL VAPOR TREATING DEVICE

BACKGROUND OF THE INVENTION

1. FIELD OF THE INVENTION

The present invention relates generally to an apparatus for collecting and treating vaporized fuel in a fuel tank without releasing the fuel vapor into the atmosphere. More particularly, the present invention pertains to a testing apparatus for testing a fuel vapor treating device.

2. DESCRIPTION OF THE RELATED ART

A fuel vapor treating device, typically mounted on a vehicle, collects and treats vaporized fuel in a fuel tank without releasing the fuel vapor into the atmosphere. As shown in FIG. 14, a typical apparatus has a canister 73 that draws in and collects fuel vaporized in a fuel tank 71 through a vapor line 72. The canister 73 is filled with an adsorbent 74 comprised of activated carbon or the like. A purge line 75, extending from the canister 73, is connected to an intake passage 77 of an engine 76. The canister 73 first adsorbs the vaporized fuel drawn in through the vapor line 72. The canister 73 collects fuel and discharges only the residual gas, from which fuel components (particularly hydrocarbon, HC) have pen extracted, into the atmosphere through a hole 78. The fuel collected in the canister 73 is purged into the intake passage 77 by way of the purge line 75 during operation of the engine 76. A purge control valve 79, provided in the purge line 75, adjust the flow rate of the fuel conveyed through the purge line 75 in accordance with the requirements of the engine 76.

In this typical treating device, damage or disconnection of the vapor line 72 may lead to a degradation in the airtightness, or sealing, of the treating device. This may result in insufficient treatment of the vaporized fuel.

Japanese Unexamined Patent Publication 6-108930 describes an apparatus that tests for malfunctions such as those described above. As shown in FIG. 15, a testing apparatus used for fuel vapor treating devices includes a fuel tank 81, a canister 82, a vapor line 83, and ex purge line 84. The purge line 84 connects the canister 8Z to an intake passage 80. A purge vacuum switching valve (VSV), or purge control valve 85, is selectively opened by an electronic control unit (ECU) 86 when the engine 76 is running. A vapor control valve 87, which is a check valve and is provided in the vapor line 83, controls the flow of vaporized fuel directed toward the canister 82 from the fuel tank 81. A difference in pressure between the fuel tank 81 side and the canister 82 side of the vapor control valve 87 opens the valve 87 and causes the vaporized fuel to flow therethrough. Opening of the valve 87 allows fuel vapor to flow into the canister 82 from the tank 81. Another control valve 90 is provided in a passageway that bypasses the vapor control valve 67 and is controlled by the ECU 86. When the control valve 90 is opened with the vapor control valve 87 in a closed state, the valve 90 allows fuel vapor to flow into the canister 82 from the tank 01. The testing apparatus includes a pressure sensor 88, which separately detects the interior pressure in the tank side of the vapor control valve 87 and the canister side of the vapor control valve 87. That is, a three-way valve 89, connected to the pressure sensor 88, including a port connected to the vapor line 83 at the side of the tank 81 and another port connected to the vapor line 83 at the side of the canister 82. The pressure sensor 88 selectively detects the tank pressure and canister pressure when the ECU 86 switches the side which the three-way valve 89 is connected to in accordance with its requirements.

The ECU 86 separately tests the sealed state of the tank side and the sealed state of the canister side based on the detected value of the tank pressure and the canister pressure.

The principle for performing testing of the sealing in the tank side will now be described. When fuel vaporizes in the tank 81 with the control valve 90 in a closed state, the tank side pressure exceeds a predetermined reference value. Holes such as punctures in the vapor line 83 would inhibit the tank side pressure from exceeding the predetermined reference value. Therefore, it is possible to test the tank side sealing by having the ECU 86 judge whether the tank side pressure, detected by the pressure sensor 88, exceeds the reference value.

When the vehicle is moving, the running state of the vehicle or the condition of the road surface causes the fuel in the tank to surge back and forth, or sway. The swaying and splashing of the fuel in the tank 81 changes the interior pressure in the tank side (the tank side pressure). Frequent swaying of feel fluctuate the tank side pressure as illustrated by a continuous line L1 in FIG. 16(*a*). Although occasional pressure fluctuations are negligible, frequent fluctuations as illustrated by line L1 in FIG. 16(*a*) result in inaccurate testing of the sealing in the tank side.

Recently, a testing apparatus that discontinues testing of the sealing in the tank side when there is frequent fuel swaying in the tank has been proposed. The apparatus is provided with a counter for indicating how often the fuel in the tank surges and the amplitude of the surges. The counter has a counter value that is incremented in accordance with the absolute value of change in the tank pressure. When the counter value reaches a predetermined value, the occurrence of fuel surges is judged to be so frequent that the sealing of the tank side cannot be accurately tested. In this case, the ongoing testing is discontinued.

When fuel in a tank surges frequently and causes the tank pressure to fluctuate, for example, as illustrated by the continuous line L1 in FIG. 16(*a*), the counter value increases as illustrated by a continuous line C1 in FIG. 16(*b*) in accordance with the pressure fluctuations. If the counter value exceeds a predetermined value CT, the surges are judged to be too frequent.

If there is a malfunction related with the sealing of the fuel tank or the vapor line, the tank pressure will be substantially equal to the atmospheric pressure. In this case, frequent surges cause only insignificant pressure fluctuations such As the ones illustrated by a dashed line L2 in FIG. 16(*a*). However, the counter value increases in accordance with the pressure fluctuations (surges of the fuel in the tank) as illustrated by a dashed line C2.

In addition to fuel surges in the tank as described above, the fuel is violently swayed by rapid acceleration, rapid deceleration and bumpy road conditions. If there is no malfunction related with the sealing, the violent swaying of the fuel temporarily and quickly raises the tank pressure. Such a change in the tank pressure is illustrated by a broken line L3 in FIG. 16(*a*). When the fuel tank is exposed to wind or rain, the temperature of the fuel drops. This quickly lowers the tank pressure.

With no malfunction related with the sealing, abrupt pressure changes in the fuel tank as described above cause the counter value to unpredictably and rapidly increase as illustrated by a broken line C3. When the counter value exceeds the predetermined value CT, the testing of the sealing in the tank side is discontinued. In other words, the testing is stopped before detecting that there is no malfunction related with the sealing of the tank side. Therefore, the normality of the sealing in the tank side is not detected.

SUMMARY OF THE INVENTION

Accordingly, it is an objective of the present invention to provide a diagnosing apparatus for a fuel vapor treating apparatus capable of appropriately diagnosing the sealing of a fuel tank side of a purge control valve.

To achieve the above objective, the present invention provides an apparatus for testing a seal of a fuel vapor treating device, wherein the treating device is for treating fuel vapor from a fuel tank, which stores fuel to be supplied to an engine, wherein the apparatus tests the seal based on a pressure in the tank after the engine is started. The apparatus includes a valve positioned between the tank and the treating device for releasing the pressure in the tank to keep the pressure lower than a first predetermined pressure that is higher than atmospheric pressure. A pressure sensor is provided for detecting the pressure in a space at a tank side of the valve, wherein the pressure in the tank changes in accordance with the operating state of the engine. A counter is provided for counting a number of deviations by a second predetermined degree of the detected pressure when the detected pressure is within a predetermined range, and a tester for selectively determining whether the seal is normal or malfunctioning based on the detected pressure when the counted value is smaller than a third predetermined value.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

FIG. 16(*a*) is a time chart illustrating fluctuations of the pressure in a fuel tank; and FIG. 16(*b*) is a time chart illustrating the behavior of counter values in accordance with the pressure fluctuations of FIG. 16(*a*).

DETAILED DESCRIPTION OF THE PREFERRED EMBODIMENTS

A first embodiment of a testing apparatus for a vehicle fuel vapor treating device according to the present invention will hereafter be described with reference to the drawings.

Figure 1:
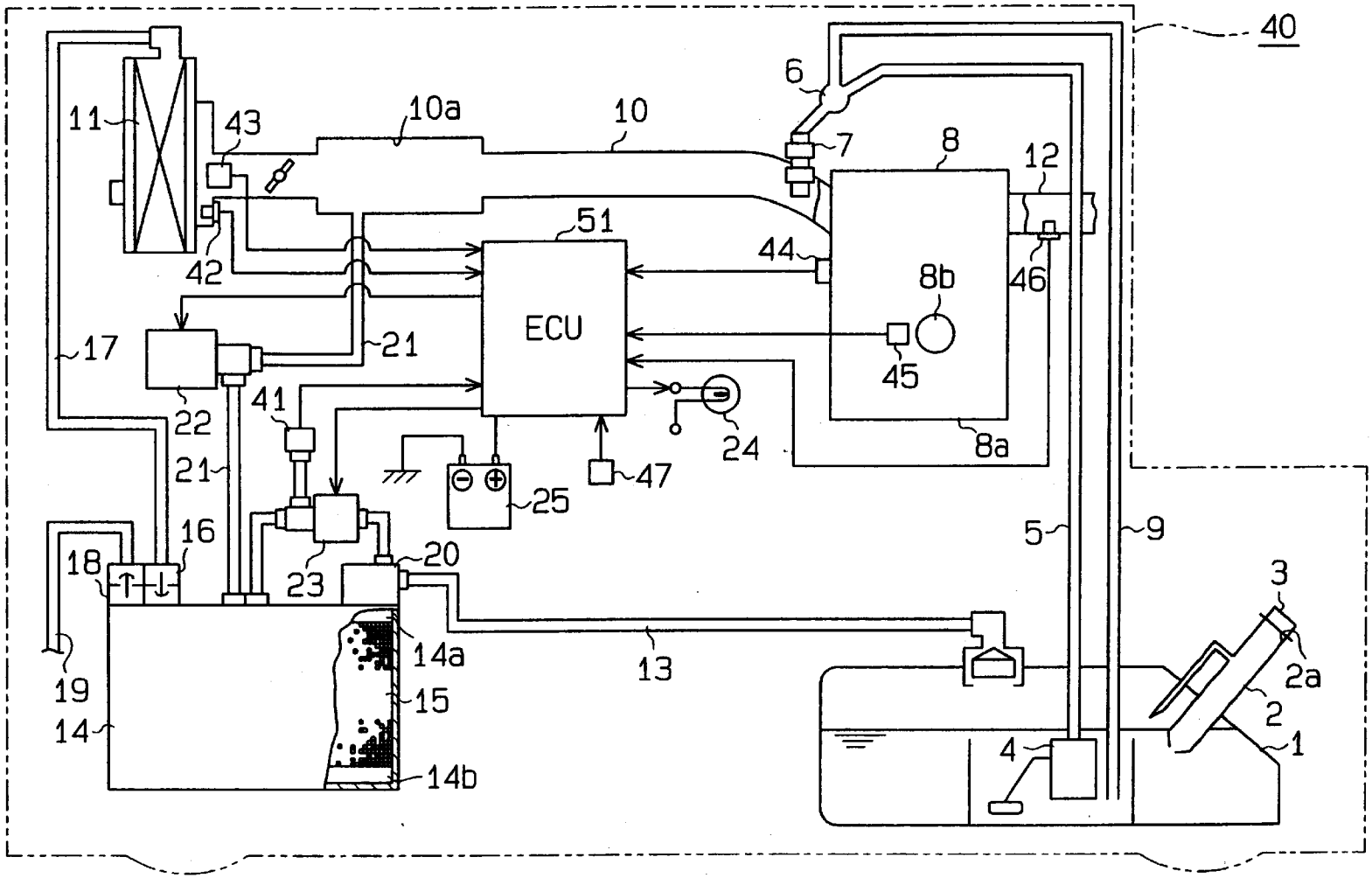
FIG. 1 is a schematic view showing a fuel vapor treating device and its testing apparatus.

Referring to FIG. 1, a gasoline engine system of a vehicle 40 has a fuel tank 1 in which fuel is reserved. The tank 1 includes a filler pipe 2 to charge fuel, or refuel the tank 1. The pipe 2 has a filler hole 2*a* into which a fuel nozzle (not shown) is inserted during refueling of the tank 1. The filler hole 2*a* is closed by a removable cap 3.

The fuel inside the tank 1 is drawn into a pump 4, incorporated in the tank 1, and discharged therefrom. A main line 5 extending from the pump 4 is connected to a delivery pipe 6. A plurality of injectors 7, provided in the pipe 6, are aligned with cylinders of an engine 8. A return line 9 extending from the pipe 6 is connected to the tank 1. Operation of the pump 4 causes the fuel discharged from the pump 4 to be sent to the delivery pipe 6 via the main line 5. The delivery pipe 6 distributes fuel to each injector 7. As each injector 7 is actuated, the fuel is injected into an intake passage 10. The intake passage 10 includes an air cleaner 11 and a surge tank 10*a*. Air flows through the air cleaner 11 and is purified when it flows therethrough. The fuel, injected from the injectors 7, is mixed with air and supplied to each cylinder of the engine 8 for combustion. The residual fuel that is not distributed to the injectors 7 is returned to the tank 1 via the return line 9. The exhaust gas produced during combustion is emitted into the atmosphere from the cylinders of the engine 8 through an exhaust passage 12.

The fuel vapor treating device of this embodiment collects and treats vaporized fuel produced in the tank 1 without releasing the fuel into the atmosphere. The fuel vapor treating device has a canister 14 to collect vaporized fuel flowing through the vapor line 13. The canister 14 is filled with an adsorbent 15 comprised of activated carbon or the like. The canister 14 includes an accommodating space, where the adsorbent 15 is accommodated, and opened spaces 14*a*, 14*b*, defined above and below the adsorbent 15.

A first control valve 16, which is a check valve, is provided in the canister 14. The control valve 16 opens when the interior pressure of the canister 14 becomes smaller than the atmospheric pressure. When opened, the control valve 16 allows atmospheric air to be drawn into the canister 14 while preventing a flow of gas in the reverse direction. An air pipe 17 extending from the control valve 16 is connected to a position near the air cleaner 11. This structure enables atmospheric air, purified by the air cleaner 11, to be drawn into the canister 14. The canister 14 is also provided with a second control valve 18, which is also a check valve. The control valve 18 opens when the interior pressure of the canister 14 becomes greater than the atmospheric pressure. When opened, the control valve 18 allows gas (internal pressure) to be released from the canister 14 through an outlet pipe 19 while preventing a reversed flow of the gas.

A vapor control valve 20, provided in the canister 14, controls the flow rate of the vaporized fuel, passing therethrough from the tank 1 to the canister 14. The control valve 20 opens in accordance with the difference between the interior pressure PT at the side of the tank 1 including the vapor line 13 (hereafter referred to as tank pressure) and the interior pressure PC at the side of the canister 14 (hereafter referred to as canister pressure). When opened, the control valve 20 allows vaporized fuel to flow into the canister 14 from the tank 1. In other words, the control valve 20 opens and allows vaporized fuel to enter the canister 14 when the value of the canister pressure PC becomes approximately the same as the atmospheric pressure and thus becomes smaller than the tank pressure PT. The control valve 20 also allows gas to flow toward the tank 1 from the canister 14 when tho canister pressure PC becomes higher than the tank pressure PT.

A purge line 21 extending from the canister 14, is connected to the surge tank 10*a*. The canister 14 collects fuel introduced through the vapor line 13 and discharges only the residual gas, from which fuel components have been extracted, into the atmosphere through the outlet pipe 19 when the control valve 18 is opened. When the engine 8 is running, the negative pressure produced in the intake passage 10 acts on the purge line 21. This causes the fuel collected in the canister 14 to be purged into the intake passage 10 through the purge line 21. A purge control valve 22, provided in the purge line 21, adjusts the flow rate of fuel passing through the line 21 when required by the engine 8. The control valve 22 is an electromagnetic valve that includes a casing and a valve body (neither is shown). The valve body is moved by an electric signal (duty signal) to open the control valve 22. The opening of the control valve 22 is duty controlled.

The testing apparatus, which performs testing of the sealing of the treating device, includes a pressure sensor 41. The pressure sensor 41 is capable of separately detecting the tank pressure PT and the canister pressure PC. A three-way valve 23 having three ports is provided with the pressure sensor 41. The three-way valve 23 connects a selected two of the three ports together based on electric signals. A first port of the three-way valve 23 is connected to the sensor 41. A second port is connected to the vapor line 13 at the tank 1 side of the control valve 20. A third port is connected to the canister 14. By switching the connected pair of ports of the three-way valve 23 when required, the pressure sensor 41 becomes selectively connected with either the vapor line 13 or the canister 14. The switching enables the pressure sensor 41 to selectively detect either the tank pressure PT or the canister pressure PC. In this embodiment, priority is given to the detection of the tank pressure PT. Thus, the three-way valve 23 is set to be connected to the vapor line 13 in case it cannot be switched by electric signals.

Various sensors 42, 43, 44, 45, 46, 47 detect the running condition of the engine 8 and the vehicle 40. The intake air temperature sensor 42, which is near the air cleaner 11, detects the temperature of the air drawn into the intake passage 10, or an intake air temperature THA, and transmits a signal based on the detected temperature value. The intake flow rate sensor 43, located near the air cleaner 11, detects the intake flow rate Q of the air drawn into the intake passage 10 and transmits a signal based on the detected flow rate. The coolant temperature sensor 44, provided on the engine 8, detects the temperature of the coolant flowing through an engine block 8*a*, or a coolant temperature THW, and transmits a signal based on the detected temperature value. The engine speed 45, provided in the engine 8, detects the revolution speed of a crank shaft 8*b*, or the engine speed NE, and transmits a signal based on the detected speed. The oxygen sensor 46, provided in the exhaust passage 12, detects the oxygen concentration Ox of the exhaust gas passing through the exhaust passage 12 and transmits a signal based on the detected value. The vehicle speed sensor 47, provided in the vehicle 40, detects the vehicle speed SPD and transmits a signal based on the detected speed.

An electronic control unit (ECU) 51 receives the signals transmitted from the sensors 41–47. The ECU 51 commands the treating device and controls fuel purging. The ECU 51 controls the purge control valve 22 and purges fuel from the canister 14 to the intake passage 10 at a flow rate corresponding to the running condition of the engine B. That is, the ECU 51 sends a duty signal to the purge control valve 22 that is necessary to control tho opening of the valve 22 in correspondence with a required duty ratio DPG.

The fuel purged into the intake passage 10 from the canister 14 influences the air-fuel ratio in the engine 8. The influence on the air-fuel ratio is taken into consideration by the ECU 51 when determining the opening of the purge control valve 22 in accordance with the running condition of the engine 8. Generally, a high air-fuel ratio results in an increase in carbon monoxide (CO) concentration of the exhaust gas from an engine. Thus, the ECU 51 computes a purge concentration FGPG (a purge concentration FCPGI during idling of the engine 8) from the oxygen concentration Ox of the exhaust gas detected by the oxygen sensor 46. Based on the computed value, the ECU 51 determines the duty ratio DPG for the opening of the purge control valve 22, and transmits a duty signal in accordance with the value of the determined duty ratio DPG to the purge control valve 22.

The ECU 51 also commands the testing apparatus. In accordance with the results detected by the sensors 41–47, the ECU 51 switches the connected ports of the three-way valve 23 and selectively reads either the value of the tank pressure PT or the canister pressure PC, which are detected by the pressure sensor 41. The ECU 51 performs tests related to the sealing of the tank side and the sealing of the canister side based on the values of the tank pressure PT and the canister pressure PC.

The ECU 51 performs tests of the purge control valve 22 and the three-way valve 23 based on the values detected by the sensors 41–47. A warning lamp 24, arranged on an instrument panel in front of the driver's seat, informs the driver of the result of the tests performed by the ECU 51. The warning lamp 24 is lit when there is a malfunction in the treating device or the testing apparatus. The lamp 24 remains turned off when the treating device and the testing apparatus are in a normal state. The ECU 51 is energized by a battery 25 and concurrently judges the voltage state of the battery 25.

Figure 2:
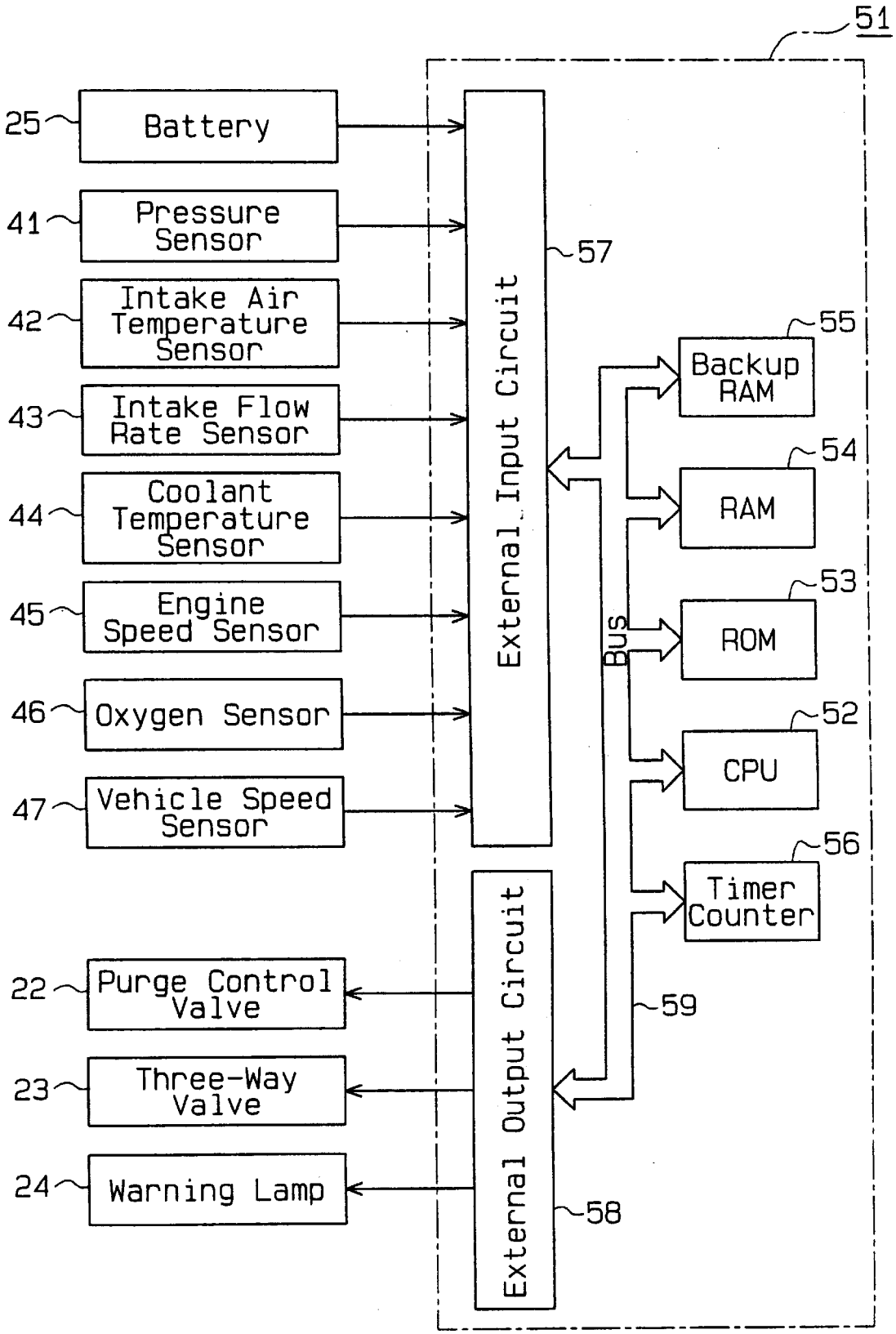
FIG. 2 is a block circuit diagram illustrating the structure of an ECU.

As shown in the block diagram of FIG. 2, the ECU 51 includes a central processing unit (CPU) 52, a read-only memory (ROM) 53, a random access memory (RAM) 54, a backup RAM 55, and a timer counter 56. In the ECU 51, a logical computing circuit is formed by the CPU 52, the ROM 53, the RAM 54, the backup RAM 55, the timer counter 56, an external input circuit 57, an external output circuit 58, and a bus 59, which connects these parts to one another. The ROM 53 prestores a predetermined program related to the fuel purging and malfunction testing. The RAM 54 temporarily stores the computed results of the CPU 52. The backup RAM 55 prestores data. The timer counter 56 simultaneously executes a plurality of time measurements. The external input circuit 57 includes a buffer, a waveform shaping circuit, a hard filter (a circuit having an electric resistor and a condenser), and an analog to digital (A/D) converter. The external output circuit 58 includes a drive circuit. The sensors 41–47 and the battery 25 are connected to the external input circuit 57, The purge control valve 22, the three-way valve 23, and the warning lamp 24 are connected to the external output circuit 58.

A process for the test of the sealing of the tank side, which is performed by the ECU 51, will hereafter be described with reference to tho drawings. The process is the principal part of the present invention.

As described in the prior art section, the running condition of the vehicle 40 and the condition of the road surface may cause fuel in the tank to sway and surge. Frequent generation of fuel surges fluctuates the tank pressure PT. This hinders accurate testing of sealing.

Figure 3:
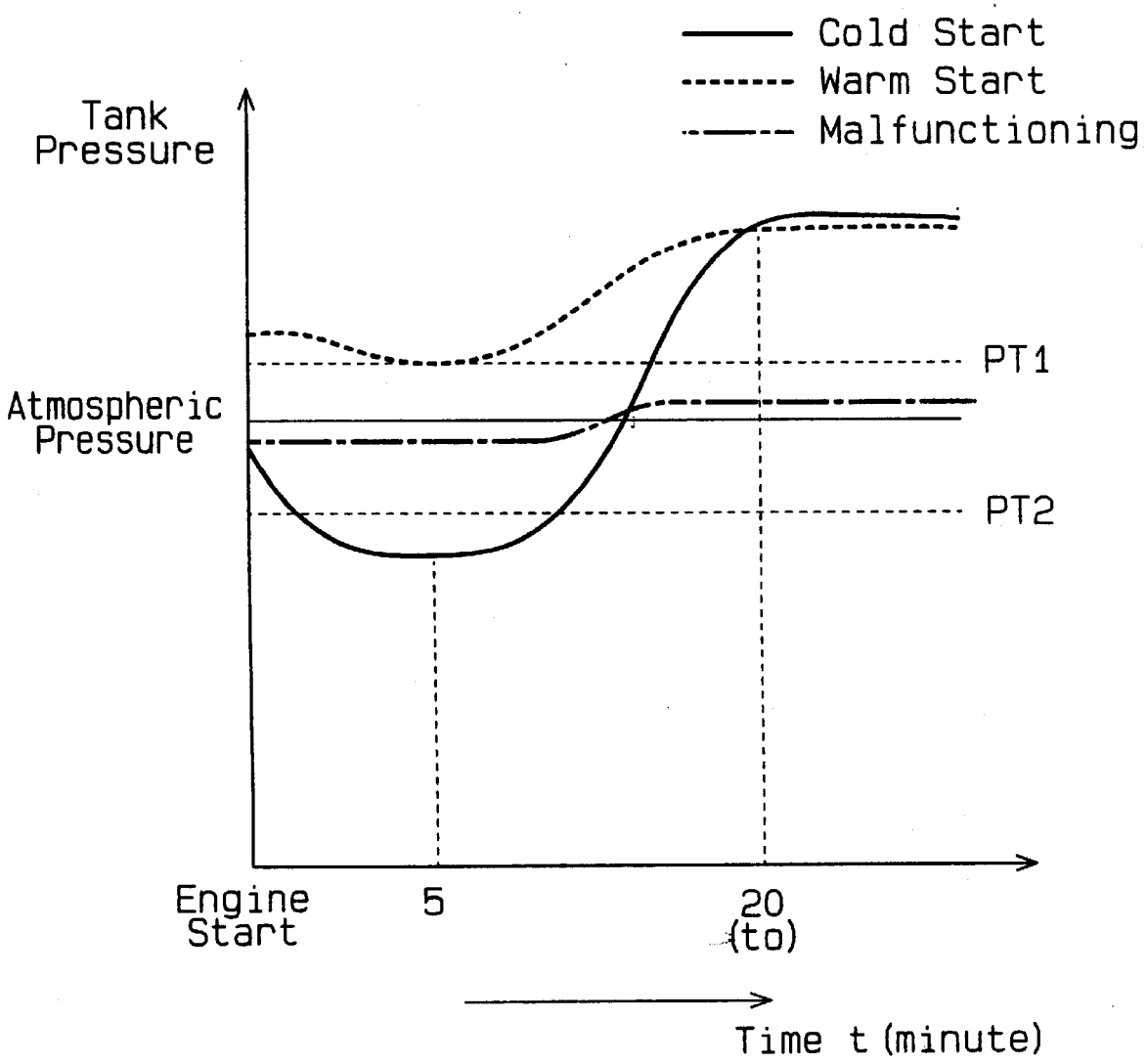
FIG. 3 is a graph of fluctuations of pressure in a fuel tank for explaining a method for testing the sealing of a fuel tank side of a purge control valve.

The ECU 51 perform various processing for ensuring the accurate testing of sealing. A method described in FIG. 3 is employed for testing the sealing of the tank 1 side. The method will hereafter be described.

If the engine 8 is started when its temperature is low, the surface of the fuel in the tank 1 is lowered by the fuel consumption. This temporarily lowers the tank pressure PT. The pressure PT thus becomes negative. In normal states, the pressure PT is minimized about five minutes after the engine 8 is started. Thereafter, surplus fuel is returned to the tank 1 by the return line 9. This increases the fuel temperature in the tank 8 thereby gradually raising the tank pressure PT. In general, the tank pressure PT becomes high enough to open the vapor control valve 20 about twenty minutes after the engine 8 is started.

When the engine 8 is warm, or when the engine 8 is re-started shortly after stopping, the pressure PT is higher than the atmospheric pressure at the time of the engine start as illustrated by a broken line in FIG. 3. The tank pressure PT is thus increased to a level high enough to open the vapor control valve 20 in a relatively short time period.

However, if there are punctures or cracks in the tank 1 or the vapor line 13, the air leaks out from the puncture or the crack. In this case, the pressure PT remains in the vicinity of the atmospheric pressure as illustrated by a dashed line of FIG. 3 regardless of the increase in the fuel temperature.

This property of the tank pressure PT is used to test the sealing of the tank 1 side. Specifically, if the tank pressure PT exceeds a first reference value PT1 or drops below a second reference value PT2 after a predetermined period (for example 20 minutes) has passed since starting of the engine 8, the sealing of the tank side is determined to be normal. The sealing is determined to be abnormal if the tank pressure PT remains between the values PT1 and PT2 during the predetermined period of time. The reference values PT1 and PT2 are selected in accordance with the size of a puncture or a crack to be detected. For example, if the diameter of the puncture to be detected is about 1 mm, the reference value PT1 is set to a pressure that is 0.3 KPa (30 mmAq(millimeter water column)) higher than the atmospheric pressure and the reference value PT2 is set to a pressure that is 0.3 KPa(30 mmAq) lower than the atmospheric pressure.

A fuel surge determining routine, which will be discussed later, counts the occurrence of fuel surge in the tank 1 (a counter value of a surge counter INTP). When this counter value reaches a predetermined value CT (for example 30), it is judged that frequent pressure fluctuations that hinder an accurate testing of the sealing is taking place in the tank 1. The testing of sealing is then discontinued.

A routine for testing the sealing of the tank side will hereafter be described with reference to FIG. 4. The ECU 51 executes this routine periodically for every predetermined time interval. This routine is executed when the following conditions are satisfied.

(1) The pressure sensor 41 for testing the sealing is functioning normally.

(2) The voltage of the battery 25 is normal.

(3) The intake air temperature THA and the coolant temperature THW are in predetermined ranges, respectively.

At step 100, the ECU 51 judges whether cranking of the engine 8 has been completed. This is carried out by confirming whether the engine speed NE is higher than a predetermined value (e.g., 400 rpm). If the cranking of the engine 8 has not yet been completed, the ECU 51 proceeds to step 101. At step 101, the ECU 51 clears the timer value t, which is used to measure elapsed time since the completion of engine cranking, by setting it to zero and then proceeds to step 102. At step 102, the ECU 51 sets a flag KD, which indicator whether the test is finished, to zero. The flag KD of the value zero indicates that the testing has not been completed. The ECU 51 is then temporarily terminates the routine.

If the cranking of the engine 8 has been completed at step 100, the ECU 51 moves to step 110. At step 110, the ECU 51 judges whether the flag KD has a value of one. If the flag KD is one, the ECU 51 temporarily terminates the routine. If the flag KD is zero, the ECU 51 moves to step 111 and increments the timer value t.

At step 112, the ECU 51 judges whether the timer value t is greater than a predetermined value t0 (for example, a value indicating that twenty minutes has elapsed from the completion of engine cranking). If the timer value t is greater than the predetermined value to, the ECU 51 moves to step 120. If the timer value is equal to or smaller than the value t0, the ECU 51 moves to step 113 and reads the value of the tank pressure PT.

The ECU 51 performs the test of the sealing of the tank 1 side at steps 114, 115 by the method illustrated in FIG. 3. Specifically, the ECU 51 judges whether the pressure PT is equal to or lower than the reference value PT2 at step 114. At step 115, the ECU 51 judges whether the pressure PT is equal to or higher then the reference value PT1. If either one of the determinations of steps 114, 115 is satisfied, the ECU 51 moves to step 118 and judges whether the surge counter value INTP is smaller than a predetermined value CT, which is thirty. The counter value INTP is incremented in the fuel surge determining routine, which will later be described with reference to FIG. 6.

If the determination in step 118 is satisfied, the ECU 51 moves to step 119 and sets a flag FX to zero. The flag FX indicates whether there is a malfunction related to the sealing of the tank 1 side. In the subsequent step 120, the ECU 51 sets a flag KD to one. The flag KD indicates whether the test has been completed. The ECU 51 then temporarily terminates the routine.

If the determination of step 118 is not satisfied, the ECU 51 sets the flag KD to zero in step 102 and temporarily terminates the routine.

If the pressure PT is judged to be between the second reference value PT2 and the first reference value PT1 in steps 114 and 115, the ECU 51 moves to step 116. At step 116, the ECU 51 judges whether the fuel surge counter value INTP is less than the predetermined value CT, which is thirty. If the counter value INTP is less than the value CT, the ECU 51 sets the diagnosis flag FX to one in step 117 for indicating that there is a sealing malfunction in the tank 1 side and temporarily terminates the routine.

If the counter value INTP is equal to or greater than the predetermined value CT in step 116, the ECU 51 sets the flag KD to zero and temporarily terminates the routine.

As described in the prior art section, frequent fluctuations of tank pressure PT prevent an accurate test of the sealing of the tank 1 side. The processing of the steps 116, 118, 102 are designed to cope with this drawback.

After repeated performance of the routine, the ECU 51 determines that the timer value t is greater than the predetermined value t0 and moves to step 120. At step 120, the ECU 51 sets the flag KD to one for indicating that the test is finished.

The resultant of the testing (FX=0, which indicates that there is no malfunction related to the sealing of the tank 1 side, or FX=1, which indicates that there is malfunction related to the sealing of the tank 1 side) is stored in the backup RAM 55. If the stored test result indicates that there is a malfunction, that is, when FX is one, the ECU 51 lights the warning lamp 24 to warn the driver of the malfunction.

As described above, in the routine of FIG. 4, the ECU 51 discontinues the testing of the sealing of the tank 1 side described in FIG. 3 when there are excessively frequent fuel surges in the tank 1.

Figure 5:
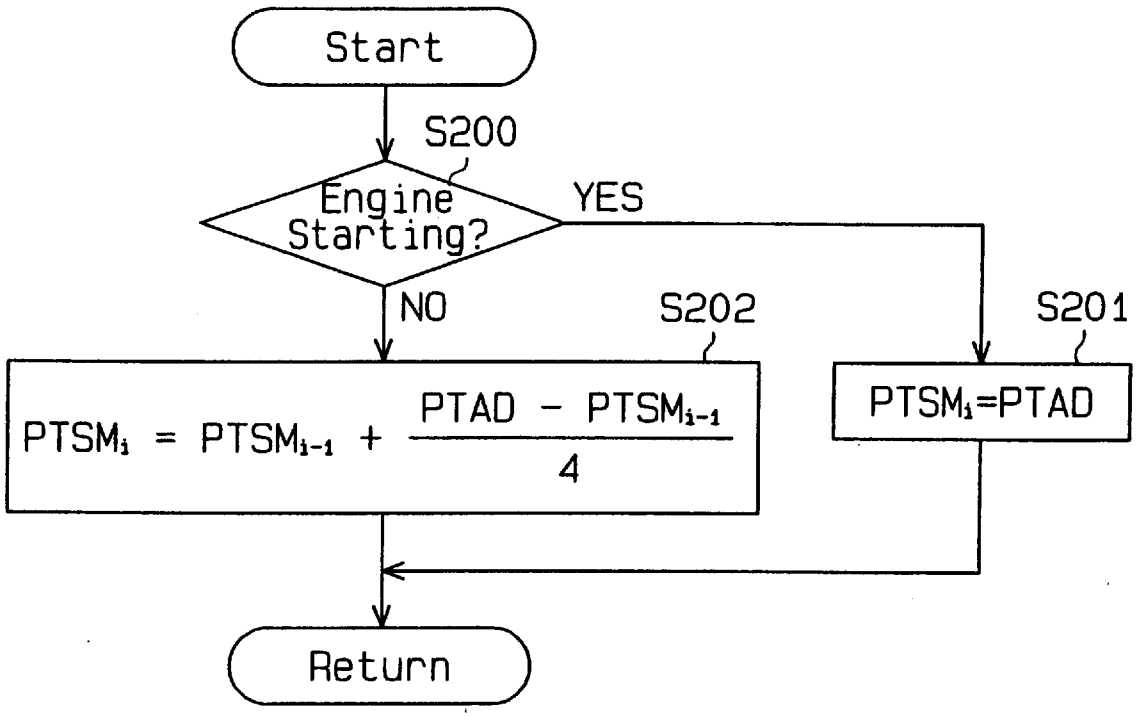
FIG. 5 is a flow chart illustrating a routine for computing an abated value of changes in a tank pressure.
Figure 6:
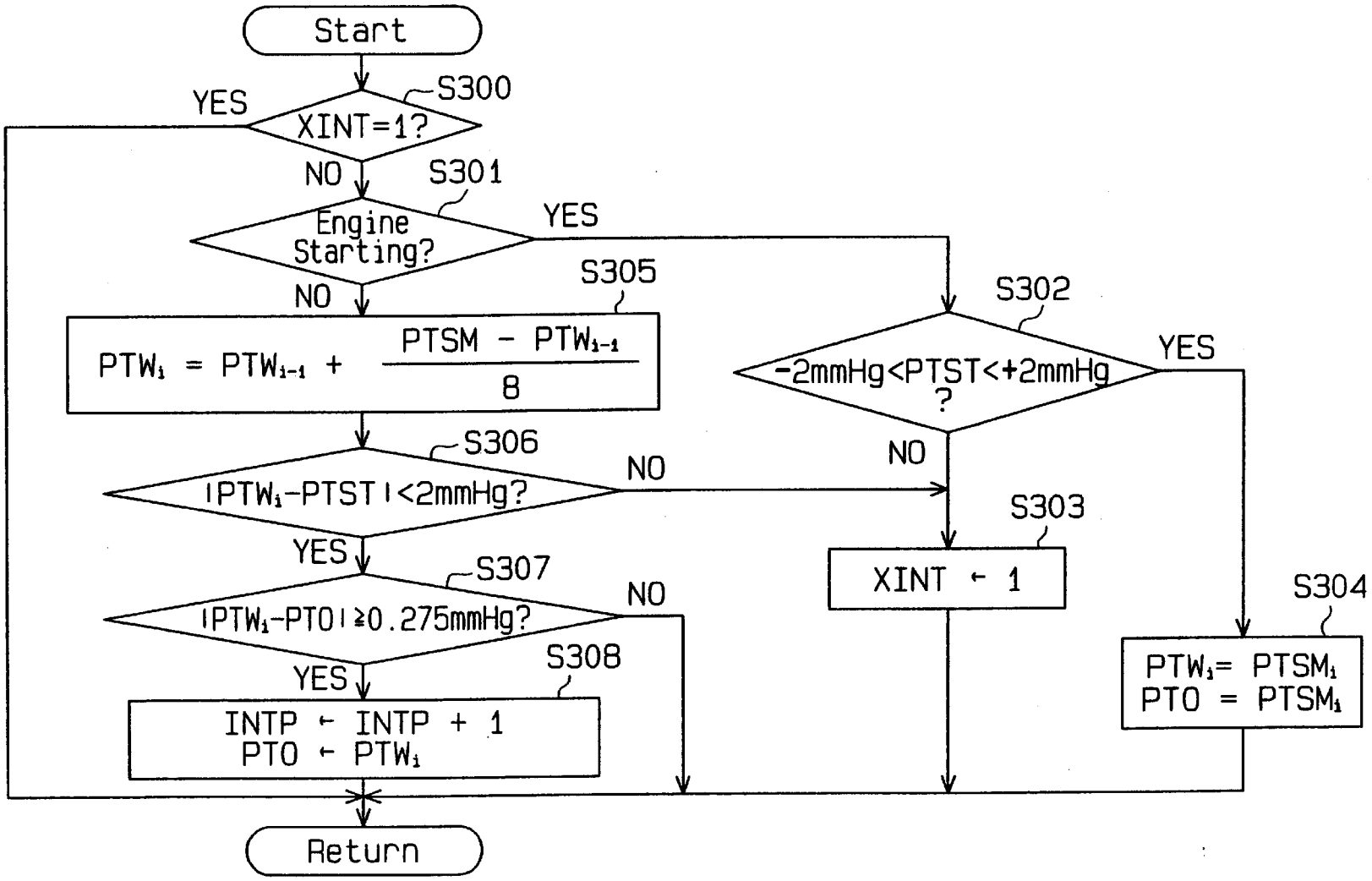
FIG. 6 is a flow chart illustrating a routine for determining fuel surges.

In this embodiment, the ECU 51 performs the test of the sealing and concurrently performs routines of FIGS. 5 and 6 for computing the counter value INTP. The routine of FIG. 5 is designed for computing an abated value of the interior pressure of the tank 1, and the routine of FIG. 6 is designed for determining the surges in the tank.

The ECU 51 monitors the tank pressure PT in the tank pressure computing routine of FIG. 5. The tank pressure computing routine is an interrupt that is carried out at a predetermined interval, for example, 64 msec.

As shown in FIG. 5, the ECU 51 judges whether the engine B is being cranked at step 200. If the engine 8 Is being cranked, the ECU 51 moves to step 201. If the engine 8 is no longer being cranked, the ECU 51 moves to step 202.

At step 201, the ECU 51 stores the digitally converted value PTAD of the tank pressure PT as an abated value (gradual change value) PTSMi in the RAM 54 and terminates the routine.

At step 202, the ECU 51 computes an abated value PTSMi based on an equation (1). Specifically, the ECU 51 substitutes an abated value PTSMi−1, which was computed in the previous routine and which is stored in the RAM 54, and a digitally converted value PTAD of the pressure PT into the equation (1) for computing an abated value PTSMi of the current routine. The ECU 51 replaces the abated value PTSMi−1 of the previous routine stored in the RAM 54 with the newly computed abated value PTSMi of the current routine.

$$PTSMi=PTSMi-1+(PTAD-PTSMi-1)/4 \quad (1)$$

The ECU 51 monitors the number of surges of fuel by the fuel surge determining routine of FIG. 6. The ECU 51 executes the routine, for example, once every one second. In this routine, the values of pressures represent relative pressure with respect to the atmospheric pressure.

In the surge determining routine, the ECU 51 confirms the state of a flag XINT in step 300. The flag XINT indicates whether the fuel surge determining is prohibited. If the flag XINT has a value of one, which indicates that the surge determining is prohibited, the ECU 51 terminates the routine. If the flag XINT is set to zero, the ECU 51 moves to step 301.

At step 301, the ECU 51 judges whether the engine B is being cranked. If the engine 8 is being cranked, the ECU 51 moves to step 302 and judges whether the tank pressure PTST with the engine 8 being cranked is in the range of predetermined tolerance (atmospheric pressure ±2 mmHg) of the pressure sensor 41. The CCU 51 judges whether the following inequality (2) is satisfied.

$$-2 \text{ mmHg} < PTST < +2 \text{ mmHg} \quad (2)$$

Figure 7:
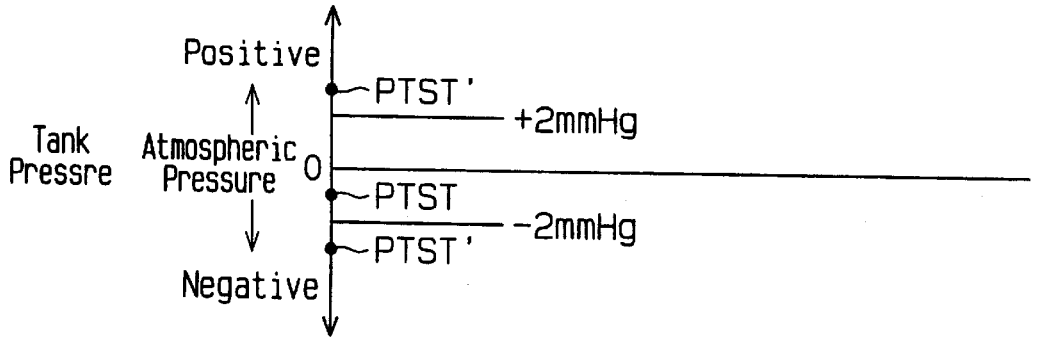
FIG. 7 is a graph showing an initial condition of the tank pressure in the fuel surge determining routine.

If the inequality (2) is not satisfied, that is, if the tank pressure PTST is out of the range of the tolerance ±2 mmHg of the pressure sensor 41 as illustrated by points PTST' in FIG. 7, the sealing of the tank 1 side is normal, In this case, the ECU 51 moves to step 303 and sets the flag XINT to one for discontinuing the processing related to the surge determining. The ECU 51 then terminates the routine.

If the inequality (2) is satisfied, tho ECU 51 moves to step 304. At step 304, the ECU 51 substitutes the abated value PTSM of the tank pressure PT into an abated value PTWi, which is used for determining the fuel swings, and a reference value PTO, which is used at every determination, and stores the renewed values PTWi and PTO in the RAM 54 in order to initiate the swing determination.

If the ECU 51 determines that the engine 8 is not being cranked in step 301, the ECU 51 moves to step 305. At step 305, the ECU 51 computes an abated value PTWi for determining fuel swings by referring to the abated value PTSM, which is obtained every 64 msec, and the abated value PTWi−1, which is obtained every 1 sec. Specifically, the ECU 51 uses the following equation (3) to compute the abated value PTWi.

$$PTWi=PTWi-1+(PTSM-PTWi1)/8 \quad (3)$$

At step 306, the ECU 51 judges whether the absolute value of the difference between the computed abated value PTWi and the tank pressure PTST is smaller than 2 mm Hg. Namely, the ECU 51 judges whether the following inequality (4) in satisfied.

$$|PTWi-PTST|<2 \text{ mmHg} \quad (4)$$

Figure 8:
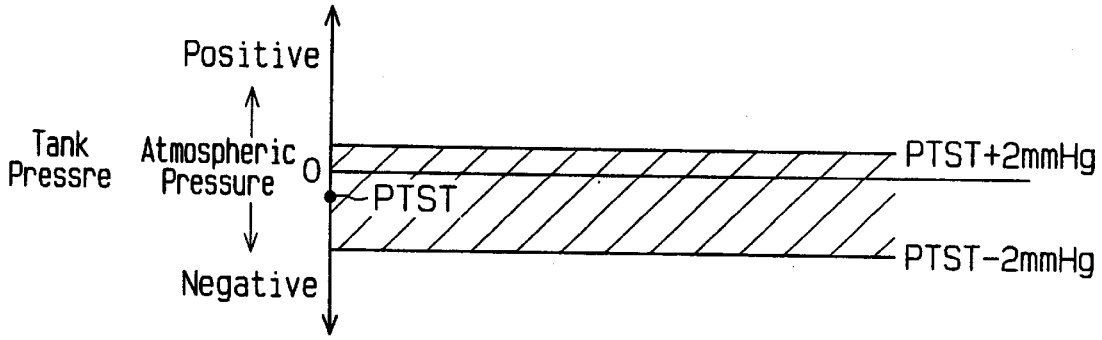
FIG. 8 is a graph showing a permissible range of pressure in the fuel surges determining routine.

If the equation (4) is not satisfied, that is, if the tank pressure PT (the abated value PTW, in reality) is not in the diagonally shaded area of FIG. 8, the ECU 51 determines that an abrupt pressure change as illustrated by the broken line L3 in FIG. 16(*a*) has occurred. When the pressure PT increases in an abrupt manner, the sealing of the tank 1 side is normal. The ECU 51 thus sets the flag XINT to one in step 303 and terminates the routine thereby discontinuing the subsequent processing of the swing determination.

If the equation (4) is satisfied, on the other hand, the ECU 51 moves to step 307. At step 307, the ECU 51 judges whether the absolute value of the difference between the computed abated value PTWi and the reference value PTO is equal to or greater than 0.275 mmHg. In short, the ECU 51 judges whether an inequality (5) is satisfied.

$$|PTW-PTO|>0.275 \text{ mmHg} \quad (5)$$

When the inequality (5) is satisfied, the ECU 51 determines that swaying of fuel is occurring in the tank 1 and moves to step 308. At step 308, the ECU 51 increments the counter value INTP and substitutes the abated value PTW into the reference value PTO. The ECU 51 then stores the renewed reference value PTO in the RAM 54. When the inequality (5) is not satisfied, the ECU 51 determines that swaying is not occurring and temporarily terminates the routine.

In this routine, the counter value INTP is not incremented in the following cases.

If the tank pressure PTST when the engine is being cranked is out of the tolerance range of the pressure sensor 41, the sealing of the tank 1 side is normal. In this case, the counter value INTP is not incremented If the tank pressure PT(the abated value PTW in reality) goes out of the range, which is set based on the pressure PTST when the engine 8 is being cranked (see the equation (4)) at least once, the sealing of the tank 1 side is normal. In this case, the counter value INTP is not incremented.

When the above two conditions are not met and change of the tank pressure PT (the abated value PTW in reality) is greater than a predetermined range (see the inequality (5)), the ECU 51 determines that swaying of fuel is occurring. In this case, the ECU 51 increments the counter value INTP.

In the above routine, the incrementation of the counter value INTP is executed based on the abated value PTW of the tank value PT. The abated value PTW is the value of a reduced amount of an actual change of the tank pressure PT. The abated values are employed for capturing the tendency of changes of the pressure PT (tendency of increase or tendency of decrease) rather than capturing rapidly occurring individual changes.

As described Above when the flag KD is set to one, the testing is terminated. The flag FX having the value of one represents the result of the testing related to the sealing. The following advantageous effects are obtained by the testing apparatus.

(1) When there is frequent swaying of fuel in the tank 1, accurate testing of sealing in the tank 1 side is not possible, In this case, the testing is inhibited. This prevents an erroneous test result.

(2) The increment of the surge counter value INTP is inhibited when the tank value PT goes out of the predetermined range, which is set based on the pressure value PTST when the engine 8 is being cranked. Therefore, the testing is not interrupted or stopped by an abrupt change of the tank pressure. Thus, testing for detecting that the sealing is normal is not stopped at an early stage.

(3) If the tank pressure PTST when the engine 8 is being cranked is out of the tolerance range of the pressure sensor 41, the counter value INTP is not incremented. Even in this case, the detection of sealing normality is not interrupted. In this case, the various computations for determining fuel surges are not performed. This simplifies of the testing.

Figure 9:
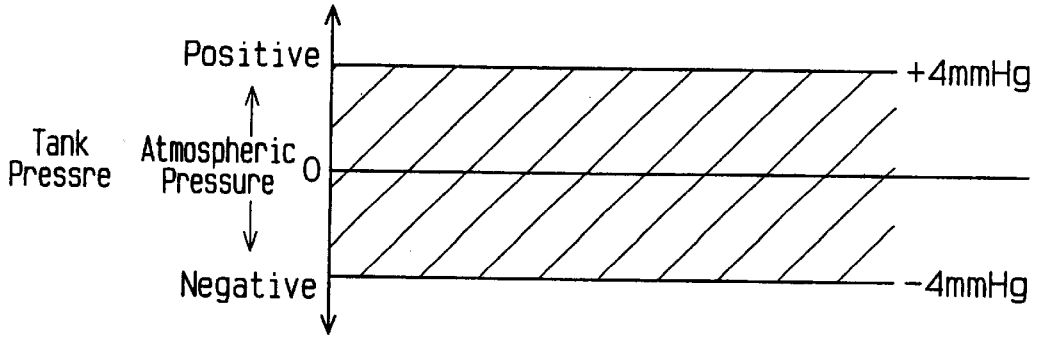
FIG. 9 is a graph showing another permissible range of pressure in the fuel surge determining routine.

In step 306 in the fuel surge determining routine, the pressure range for determining whether a pressure change is abrupt is set using the tank pressure PTST when the engine 8 is being cranked as a reference value. The pressure range may however be set arbitrarily. For example, the range may be set with respect to the atmospheric pressure while taking the tolerance of the pressure sensor 41 (±2 mmHg) into consideration. Specifically, the range may be set from −4 mmHg to +4 mmHg with respect to the atmospheric pressure as shown in FIG. 9. In this case, the inequality (4) is replaced with an equality (4') in step 306.

$$-4\ \text{mmHg} < PTW < +4\ \text{mmHg} \quad (4')$$

The inequality (4') is more simplified than the inequality (4). That is, the abated value PTW is simply compared with the values (+4 mmHg, −4 mmHg). This simplifies the processing of step 306.

Further, the steps 302, 303 may be omitted. In this case, if the determination of step 301 is satisfied, the ECU 51 moves to step 304. If the determination of step 306 is not satisfied, the ECU 51 terminates the routine.

In the above routine, the counter value INTP is not incremented if certain conditions are satisfied. This prevents detection of a normal condition from being interrupted in an early stage. However, when increased to a relatively great value, the counter value INTP indicates the sealing is normal. Thus, testing for detecting the normality of the sealing needs not be interrupted. It is therefore possible to replace the processing or FIGS. 4, 6 with the processing of FIGS. 10, 11 while maintaining the reliability of the testing.

Figure 10:
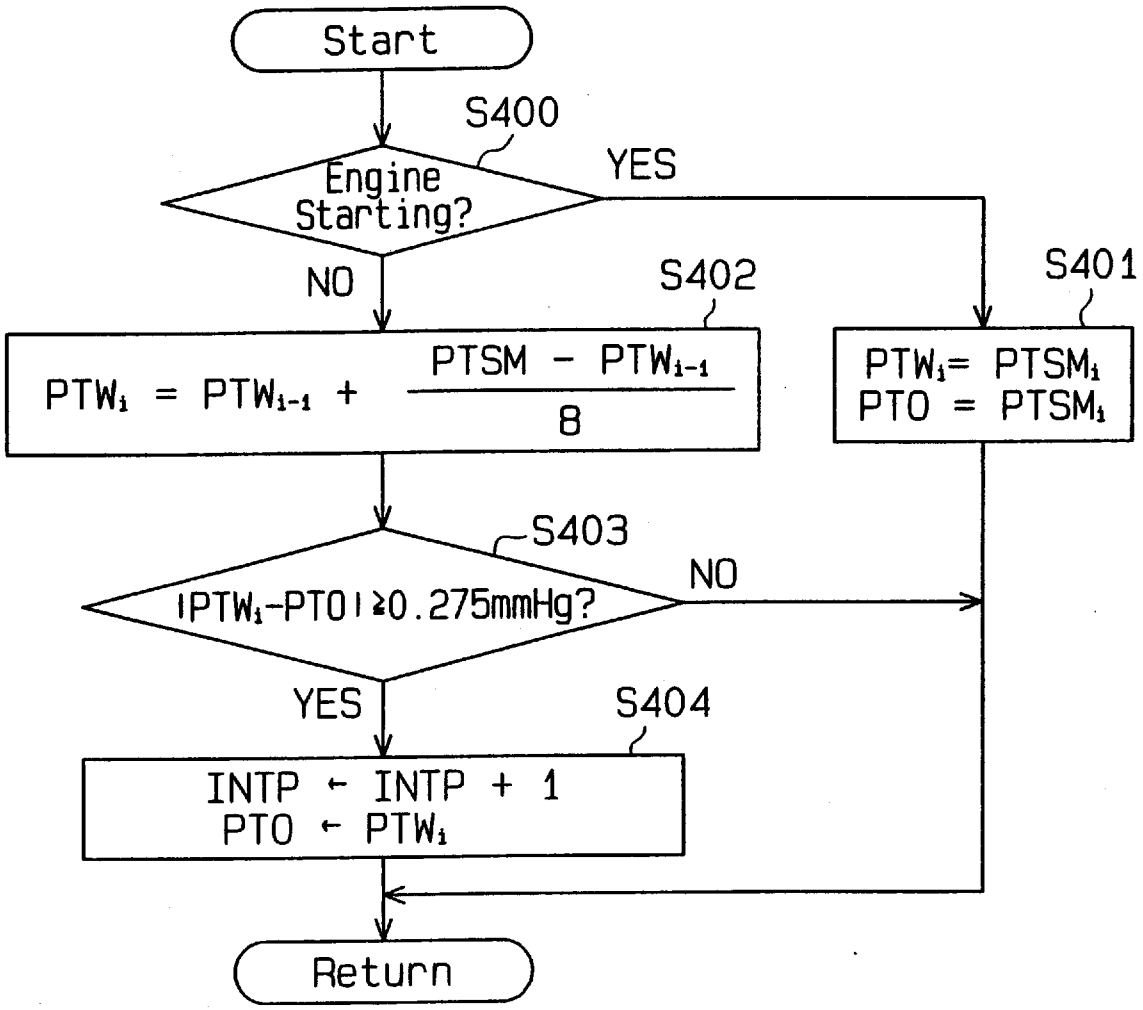
FIG. 10 is a flow chart illustrating another fuel surge determining routine.

The fuel surge determining routine of FIG. 10 is executed, for example, every 1 second. In this routine, the ECU 51 judges whetter the engine 8 is being cranked in step 400. If the determination is satisfied in step 400 the ECU 51 moves to step 401. At step 401, the ECU 51 substitutes the abated value PTW of the tank pressure PT into the abated value PTW of the pressure PT and the reference value PTO. The ECU 51 then-stores the renewed values PTW, PTO in the RAM 54.

If the engine 8 is not being cranked, the ECU 51 moves to step 403 after performing the processing of step 402. At step 403, the ECU 51 judges whether the absolute value of the difference between the computed abated value PTWi and the reference value PTO is equal to or greater than 0.275 mmHg. That is, the ECU 51 judges whether the inequality (5) is satisfied.

If the inequality (5) is satisfied, the ECU 51 judges that a swaying of fuel is occurring and moves to step 308. At step 308, the ECU 51 increments the counter value INTP.

The ECU 51 also substitutes the abated value PTW into the reference value PTO and stores the renewed value PTO in the RAM 54. If the inequality (5) is not satisfied, the ECU 51 judges that there is no swaying of fuel and temporarily is terminates the routine.

Figure 4:
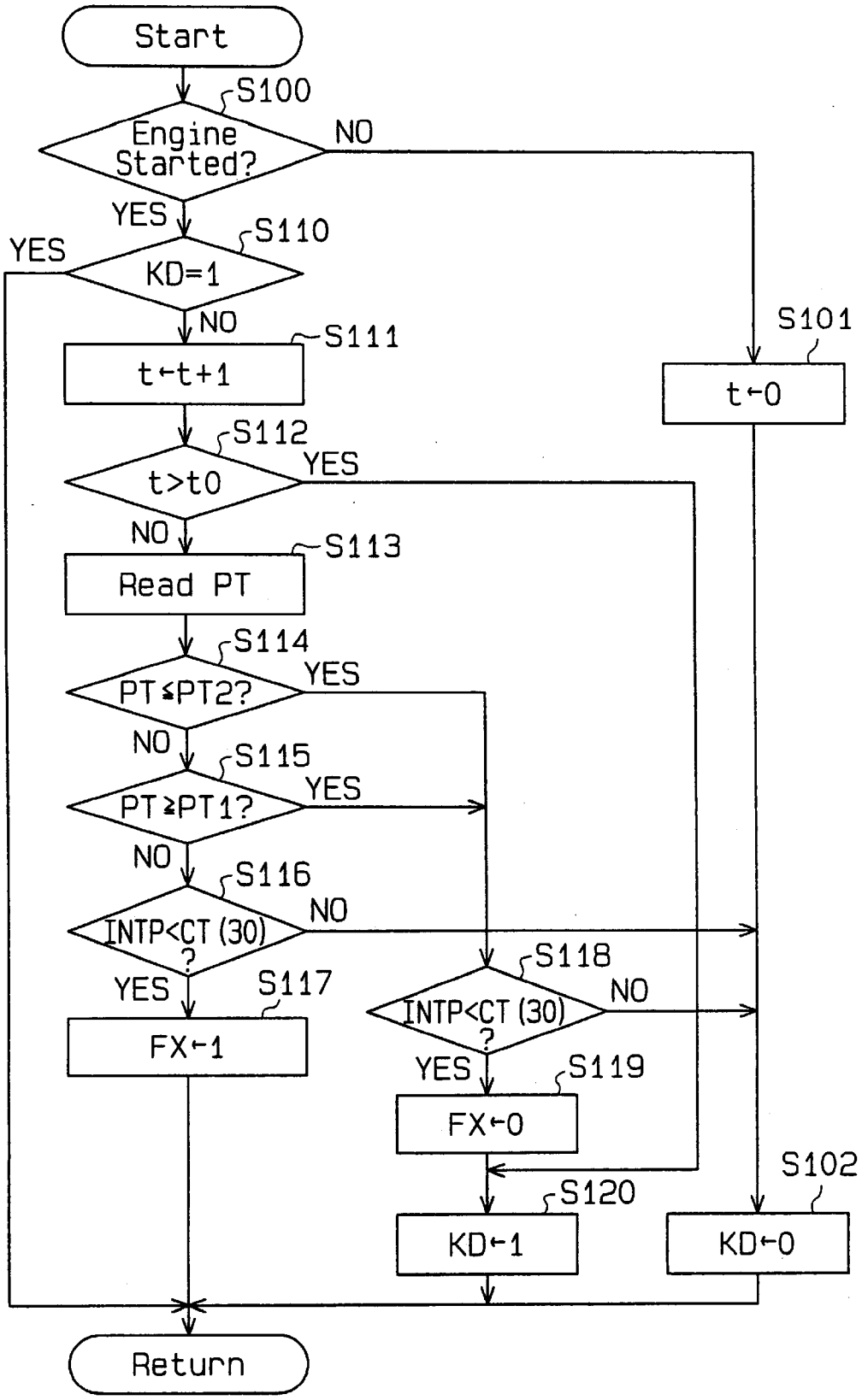
FIG. 4 is a flow chart illustrating a diagnostic routine according to a first embodiment of the present invention.
Figure 11:
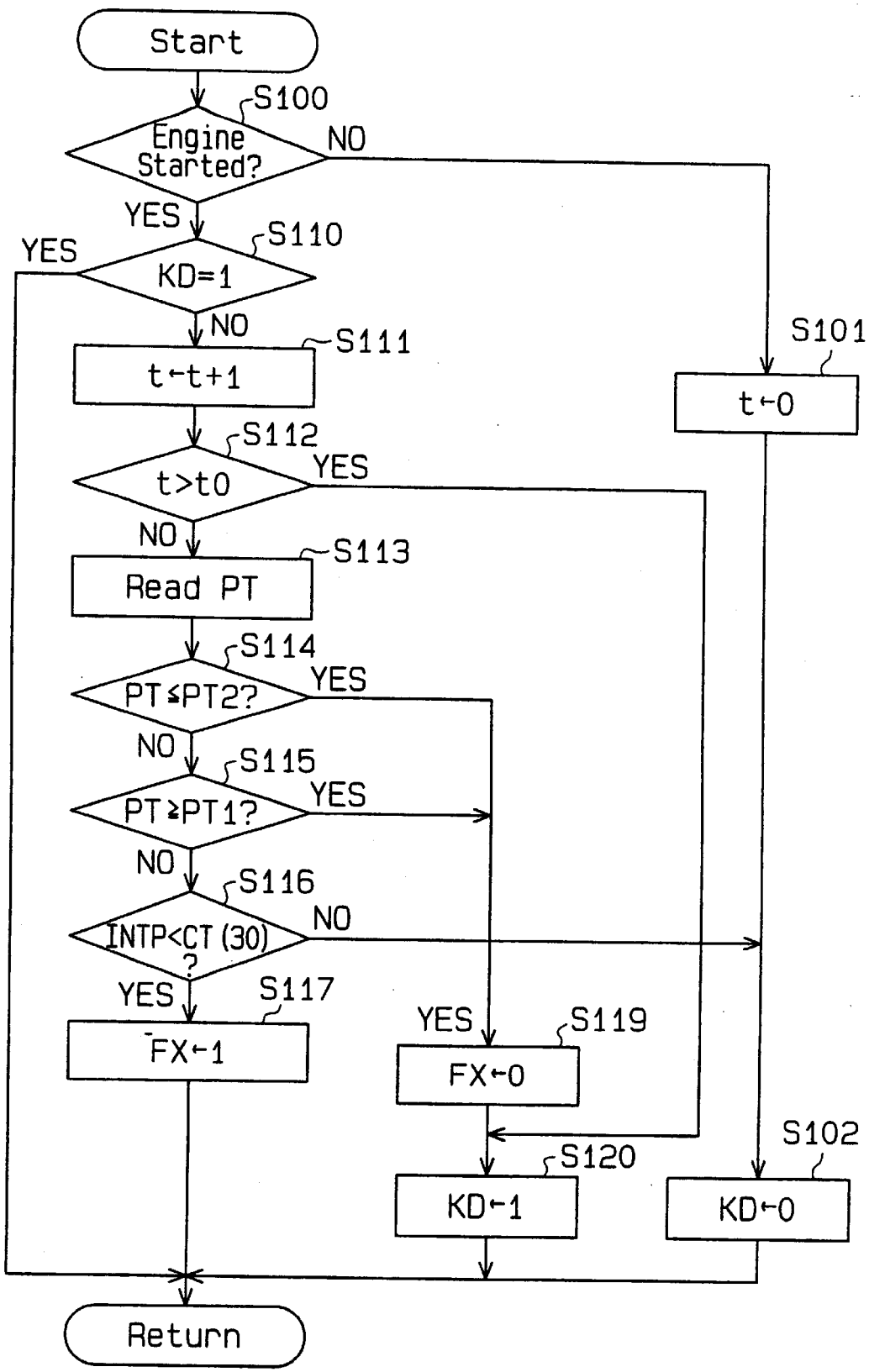
FIG. 11 is a flow chart illustrating a testing routine based on the fuel surge determining routine of FIG. 10.

The testing routine of FIG. 11 is identical with the routine of FIG. 4 except that step 118 is omitted.

In this routine, If the tank pressure is equal to or smaller than the reference value PT2, or equal to or greater than the reference value PT1, the ECU 51 determines that the sealing of the tank 1 side is normal.

It the tank pressure is between the reference value PT1 and the reference value PT2 and the counter value INTP is less than the predetermined value CT, the ECU 51 temporarily 25 determine that there in a malfunction of the sealing of the tank 1 side. In this state, if the timer value t reaches the predetermined value t0, the ECU 51 ultimately determines that there is a malfunction of the sealing of the tank 1 side.

In this routine, the counter value INTP is incremented in accordance with occurrences of every abrupt pressure change. When the value INTP reaches the predetermined value CT, the testing for detecting the abnormality of the sealing is discontinued. Abrupt pressure changes occur only when the sealing of the tank 1 side is normal. Therefore, before the counter value INTP reaches the predetermined value CT, the ECU 51 determines that the sealing is normal if the determination of step 115 is satisfied. When the counter value INTP exceeds the predetermined value CT, the ECU 51 ultimately determines that the sealing is normal if the determination of step 115 is satisfied right after the value INTP exceeds the value CT.

This method of FIG. 11 has a sufficient re-liability. Further, the method is more simplified than the flowchart of FIG. 4.

Figure 12:
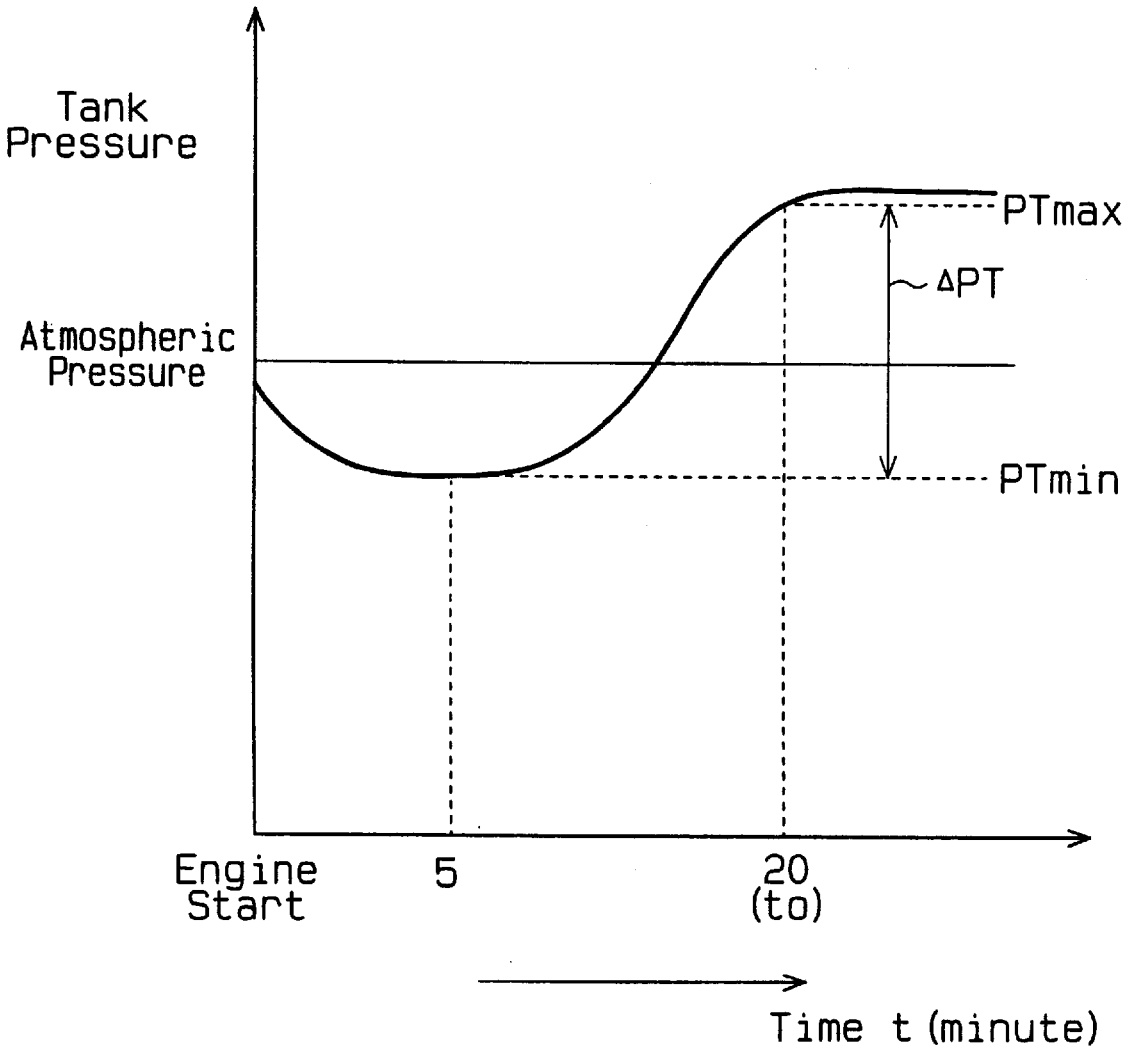
FIG. 12 is a graph of fluctuations of pressure in a fuel tank for explaining another method for testing the sealing of a fuel tank side of a purge control valve.

A method illustrated in FIG. 12 may be employed instead of the method of FIG. 3. In the method of FIG. 3, the sealing is tested based on whether the tank pressure PT is equal to or greater than the reference value PT1 or if the tank pressure is smaller than tho reference value PT2. In the method of FIG. 12, the testing is performed based on the absolute value ΔPT of the difference between the minimum value Ptmin of the tank pressure PT and the maximum value PTmax of the tank pressure PT. If the absolute value ΔPT is equal to or greater than a reference value ΔPTO (for example, about 0.6 KPa), the ECU 51 determines that the sealing is normal. If the value ΔPT is smaller than the reference value ΔPTO, the ECU 51 determines that there is a malfunction related to the sealing.

Figure 13:
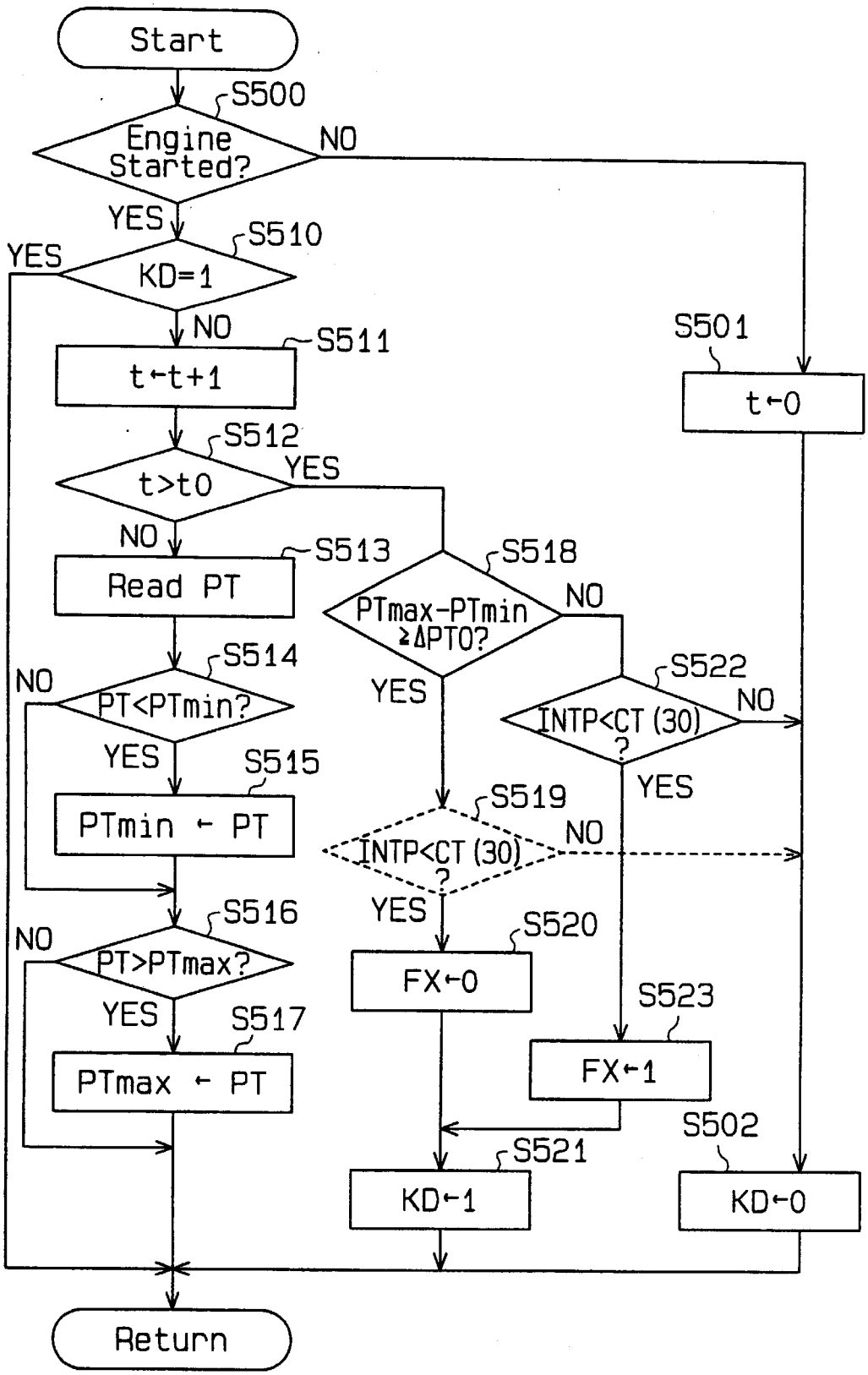
FIG. 13 is a flow chart illustrating a testing routine based on the testing method of FIG. 12.
Figure 14:
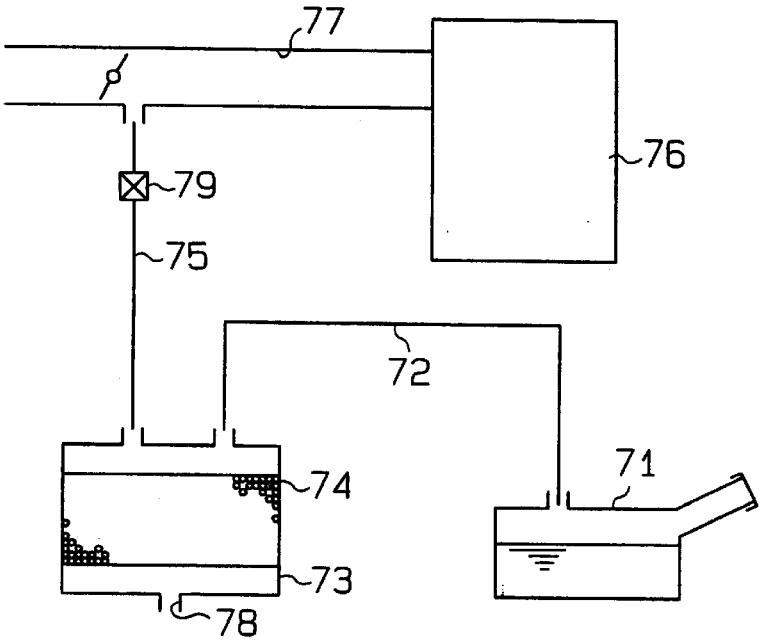
Fig.14 (PRIOR ART)
FIG. 14 is a schematic view showing a prior art fuel vapor treating device.
Figure 15:
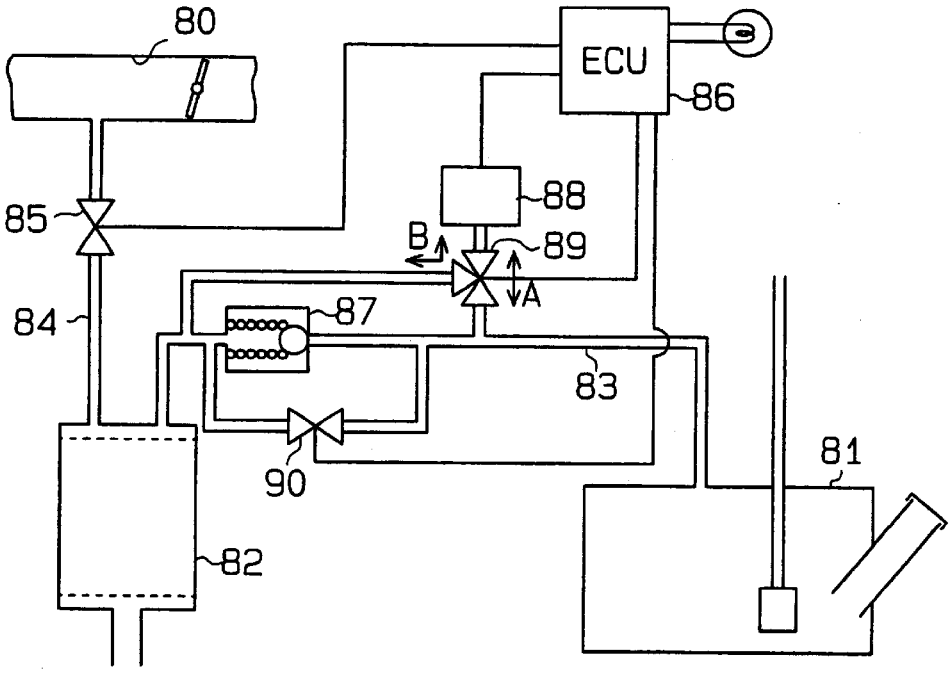
Fig.15 (PRIOR ART)
FIG. 15 is a schematic view showing a testing apparatus for the prior art fuel vapor treating device.

FIG. 13 shows a routine for testing the sealing of the tank 1 side according to the method of FIG. 12. In this routine, the counter value INTP is monitored through the routine of FIG. 6. When the counter value INTP exceeds the predetermined value CT, the testing is discontinued. The conditions for executing the routine are the same as the routine of FIG. 4.

In this routine, the processing of the steps 500 to 513 are the same as the corresponding processing of the steps 100 to 113 of FIG. 4.

If the determination of step 512 is not satisfied, the ECU 51 moves to step 513 to perform the processing. The ECU 51 thereafter moves to step 514. At step 514, the ECU 51 judges whether the tank pressure PT is smaller than the minimum value PTmin. If the determination is satisfied in step 514, the ECU 51 moves to step 515 and substitutes the current pressure PT into the minimum PTmin. If the determination is not satisfied in step 514, the ECU 51 moves to step 516.

At step 516, the ECU 51 judges whether the current tank pressure PT is greater than the maximum value PTmax. If the determination is satisfied, the ECU 51 moves to step 517, At step 517, the ECU 51 substitutes the current pressure PT into the maximum value PTmax and terminates the routine. If the determination of atop 516 is not satisfied, the ECU 51 terminates the routine.

When the timer value t is determined to have reached the predetermined value t0 in step 512, the ECU 51 moves to step 518. At step 51B, the ECU 51 judges whether the absolute value ΔPT of the difference between the maximum value PTmax and the minimum value PTmin is equal to or greater than the reference value ΔPTO. That is, the ECU 51 judges whether an inequality (6) is satisfied.

$$PTmax-PTmin \geqq \Delta PTO \quad (6)$$

If the inequality (6) is satisfied, the ECU 51 judges whether the counter value INTP computed in the routine of FIG. 6 is smaller than the reference value CT. If the determination is satisfied the ECU 51 moves to step 520. At step 520, the ECU 51 sets the flag FX to zero for indicating normality of the sealing. At step 521, the ECU 51 sets the flag KD to one for indicating the termination of tho testing and temporarily terminates the routine.

If the determination of step 519 is not satisfied, the ECU 51 moves to step 502 without judging the normality of the sealing. At step 502, the ECU 51 sets the flag KD to zero and temporarily terminates the routine.

If the determination of step 518 is not satisfied, the ECU 51 moves to step 522. At step 522, the ECU 51 judges whether the counter value INTP is smaller than the reference value CT. If the determination is satisfied, the ECU 51 moves to step 523. At step 523, the ECU 51 sets the flag FX to one for indicating that there is a malfunction related to the sealing. If the determination is not satisfied in step 522, the ECU 51 executes the processing of step 502 and terminates the routine.

If the routine of FIG. 10 is adapted with the routine of FIG. 13, step 519 of FIG. 13, which is illustrated by a broken line, may be omitted. This simplifies the processing of the testing without affecting the reliability of the testing.

If the routine of FIG. 13 is executed concurrently with the routine of FIG. 6, the detection of normality of the sealing is not interrupted at an early stage. This is because the counter value INTP is not incremented when certain determinations are not satisfied in the routine of FIG. 6.

In the routine of FIG. 6, the processing of step 306 may be either of the inequalities (4) or (4').

Other testing for the sealing than those of FIGS. 3 and 12 may be employed. For example, the sealing may be tested based on the time integral of the tank pressure PT. The same advantageous effects as the above preferred embodiment are obtained even if another method for testing the sealing is employed as long as the testing is performed based on the following method.

If the pressure PT, which is in a predetermined range, fluctuates above or below the predetermined range, the counter value INTP is incremented. If the incremented value INTP is smaller than the predetermined value CT, the sealing is tested.

When the counter value INTP is incremented based on fluctuations of the tank pressure PT above or below the predetermined range, the test of the normality of the sealing is continued regardless of the counter value INTP. In this case, the detection of abnormal sealing is executed only when the counter value INTP is smaller than a predetermined value CT.

Therefore, the present examples and embodiments are to be considered as illustrative and not restrictive and the invention is not to be limited to the details given herein, but may be modified within the scope and equivalence of the appended claims.

What is claimed is:

1. An apparatus for testing a seal of a fuel vapor treating device, wherein the treating device is for treating fuel vapor from a fuel tank, which stores fuel to be supplied to an engine, wherein the apparatus tests the seal based on a pressure in the tank after the engine is started, the apparatus comprising:

a valve positioned between the tank and the treating device for releasing the pressure in the tank to keep the pressure lower than a first predetermined pressure that is higher than atmospheric pressure;

a pressure sensor for detecting the pressure in a space at a tank side of the valve, wherein the pressure in the tank changes in accordance with the operating state of the engine;

a counter for counting a number of deviations by a second predetermined degree of the detected pressure when the detected pressure is within a predetermined range; and a tester for selectively determining whether the seal is normal or malfunctioning based on the detected pressure when the counted value is smaller than a third predetermined value.

2. The apparatus According to claim 1, wherein the counter stops counting when the detected pressure exceeds the predetermined range after the engine starts.

3. The apparatus according to claim 1, wherein the tester finishes determining whether the seal is normal or malfunctioning within a predetermined time period after the engine starts.

4. The apparatus according to claim 3, wherein the testing operation is finished when the tester determines that the seal is normal.

5. The apparatus according to claim 2, wherein the tester determines that the seal is normal when the detected pressure exceeds the predetermined range.

6. The apparatus according to claim 3, wherein the detected pressure during the predetermined time period has a maximum value and a minimum value, and wherein the tester determines that the seal is normal when a difference between the maximum value and minimum value is greater than a predetermined value.

7. The apparatus according to claim 3, wherein the tester determines that the seal is malfunctioning when the detected pressure is kept within the predetermined range during the predetermined time period.

8. The apparatus according to claim 1, further comprising a setting means for setting the predetermined range based on the pressure in the tank at a time when the engine is started.

9. The apparatus according to claim 1, wherein the predetermined range has an upper value that is greater than atmospheric pressure and lower value that is smaller than atmospheric pressure.

10. An apparatus for testing a seal of a fuel vapor treating device, wherein the treating device is for treating fuel vapor from a fuel tank, which stores fuel to be supplied to an engine, wherein the apparatus tests the seal based on a pressure in the tank after the engine is started, the apparatus comprising:

a valve positioned between the tank and the treating device for releasing the pressure in the tank to keep the pressure lower than a first predetermined pressure that is higher than atmospheric pressure;

a pressure sensor for detecting the pressure in a space at a tank side of the valve, wherein the pressure in the tank changes in accordance with the operating state of the engine;

a counter for counting a number of deviations by a second predetermined degree of the detected pressure when the detected pressure is within a predetermined range; and a first tester for determining whether the seal is normal based on the detected pressure regardless of the counted value; and a second tester for determining whether the seal is malfunctioning based on the detected pressure when the counted value is smaller than a predetermined value.

11. The apparatus according to claim 10, wherein the first and second testers finish determining whether the seal is normal or malfunctioning within a predetermined time period after the engine starts.

12. The apparatus according to claim 11, wherein the testing operation by the first and second testers are finished when the first tester determines the seal is normal.

13. The apparatus according to claim 10, wherein the first tester determines that the seal is normal when the detected pressure exceeds the predetermined range.

14. The apparatus according to claim 11, wherein the detected pressure during the predetermined time period has a maximum value and a minimum value, and wherein the tester determines the seal is normal when a difference between the maximum value and minimum value is greater than a predetermined value.

15. The apparatus according to claim 11, wherein the second tester determines that the seal is malfunctioning when the detected pressure is kept within the predetermined range during the predetermined time period.

16. The apparatus according to claim 10, further comprising a setting means for setting the predetermined range based on the pressure in the tank at a time when the engine is started.

17. The apparatus according to claim 10, wherein the predetermined range has an upper value that is greater than atmospheric pressure and lower value that is smaller than atmospheric pressure.

18. The apparatus according to claim 1, wherein the engine has an intake passage, the treating device includes:

a canister for collecting fuel vapor generated in the fuel tank;

a vapor line for connecting the canister with the tank, wherein the valve is positioned in the vapor line; and a purge line for purging the collected fuel in the canister into the intake passage by a negative pressure generated in the passage during operation of the engine.

* * * * *

UNITED STATES PATENT AND TRADEMARK OFFICE

CERTIFICATE OF CORRECTION

PATENT NO. : 5,857,447

DATED : 12 January 1999

INVENTOR(S) : Susumo SHINOHARA et al.

It is certified that error appears in the above-identified patent and that said Letters Patent is hereby corrected as shown below:

| Column | Line | |
|---|---|---|
| 1 | 24 | Change "pen" to --been--. |
| 1 | 40 | Change "ex" to --a--. |
| 1 | 41 | Change "**8Z**" to --**82**--. |
| 1 | 54 | Change "**67**" to --**87**--. |
| 1 | 57 | Change "**01**." to --**81**.--. |
| 2 | 18 | Change "feel" to --fuel--; change "fluctuate" to --fluctuates--. |
| 2 | 29 | Replace "change" with --changes--. |
| 3 | 29 | Replace "principals" with --principles--. |
| 3 | 53 | Replace "surges" with --surge--. |
| 5 | 12 | Replace "tho" with --the--. |

UNITED STATES PATENT AND TRADEMARK OFFICE

CERTIFICATE OF CORRECTION

PATENT NO. : 5,857,447

DATED : 12 January 1999

INVENTOR(S) : Susumo SHINOHARA et al.

It is certified that error appears in the above-identified patent and that said Letters Patent is hereby corrected as shown below:

| Column | Line | |
|---|---|---|
| 6 | 11 | Change "engine **B**" to --engine **8**--. |
| 6 | 13 | Replace "tho" with --the--. |
| 7 | 7 | Replace "tho" with --the--. |
| 7 | 14 | Replace "perform" with --performs--. |
| 8 | 19 | Before "then" delete "is". |
| 8 | 31 | Replace "to," with --t0,--. |
| 9 | 32 | Replace "**B**" with --**8**--. |
| 9 | 63 | Replace "**B**" with --**8**--. |
| 10 | 28 | Replace equation (3) with: $PTWi=PTWi-1+(PTWi-1)/8$ |
| 10 | 12 | Replace "tho" with --the--. |

UNITED STATES PATENT AND TRADEMARK OFFICE

CERTIFICATE OF CORRECTION

PATENT NO. : 5,857,447

DATED : 12 January 1999

INVENTOR(S) : Susumo SHINOHARA et al.

It is certified that error appears in the above-identified patent and that said Letters Patent is hereby corrected as shown below:

| Column | Line | |
|---|---|---|
| 10 | 34 | Change "in" to --is--. |
| 10 | 52 | Replace equation (5) with: $\lvert PTW-PTO \rvert \geq 0.275$ mmHg |
| 11 | 42 | After "simplifies" delete "of". |
| 12 | 12 | Replace "PTW" with --PTSM--. |
| 12 | 40 | Delete "**25**"; change "determine" to --determines--.. |
| 12 | 58 | Replace "re-liability" with --reliability--. |
| 13 | 32 | Replace "atop" with --step--. |
| 13 | 49 | Replace "tho" with --the--. |

Signed and Sealed this

Fifth Day of September, 2000

*Attest:*

*Attesting Officer*

Q. TODD DICKINSON

*Director of Patents and Trademarks*